US005592781A

United States Patent [19]

Mauro

[11] Patent Number: 5,592,781

[45] Date of Patent: Jan. 14, 1997

[54] ROTATING TILT LATCH

[76] Inventor: Gerald D. Mauro, 135 Springhouse La., Pittsburgh, Pa. 15238

[21] Appl. No.: 444,906

[22] Filed: May 19, 1995

[51] Int. Cl.[6] ..... E05B 65/08; E05C 17/00; E05C 19/00

[52] U.S. Cl. ..... 49/394; 49/161

[58] Field of Search ..... 49/161, 174, 394, 49/176, 181, 428

[56] References Cited

U.S. PATENT DOCUMENTS

| | | | |
|---|---|---|---|
| 2,694,840 | 11/1954 | Smith | 49/428 |
| 3,116,520 | 1/1964 | MacGregor | 49/429 |
| 3,153,818 | 10/1964 | Osten | 49/174 |
| 3,184,784 | 5/1965 | Peters | 49/174 |
| 4,955,159 | 9/1990 | Rogers | 49/161 |
| 5,251,401 | 10/1993 | Prete et al. | 49/181 |

FOREIGN PATENT DOCUMENTS

| | | | |
|---|---|---|---|
| 825431 | 10/1969 | Canada | 49/428 |
| 920/8867 | 5/1992 | WIPO | 49/161 |

*Primary Examiner*—Kenneth J. Dorner

*Assistant Examiner*—Curtis A. Cohen

*Attorney, Agent, or Firm*—Kirk D. Houser; Eckert Seamans Cherin & Mellott

[57] ABSTRACT

A window having a frame and at least one sash that is at least partially removable from the frame. The frame includes a sash opening and at least one sash engaging surface. At least one sash having at least one frame engaging surface is slidably mounted in the sash opening of the frame so that the frame engaging surface at least partially engages the sash engaging surface. At least one sash stop is mounted in the frame and is movable between an extended position and a retracted position. The sash stop is structured to maintain the sash in position in the sash opening when the sash stop is in the extended position. The sash stop includes resilient means between the frame and the sash stop for urging the sash stop into the extended position. At least one latch is rotatably mounted on the sash and positioned adjacent to the sash stop. The latch is rotatable between a closed position and an open position. In the closed position, the latch does not engage the sash stop. In the open position, the latch engages and depresses the sash stop so that the sash may be at least partially removed from the frame past the sash stop. A method of making the window is also provided.

12 Claims, 7 Drawing Sheets

ROTATING TILT LATCH

BACKGROUND OF THE INVENTION

1. Field of the Invention

This invention relates to windows, and, more particularly, to windows having one or more sashes that are tiltable or rotatable out of the window frame for cleaning and the like.

2. Related Art

It is common practice in modem window manufacturing to construct windows from a variety of materials, such as wood, steel, aluminum, vinyl, fiberglass and composites of such materials. It is also common to manufacture double hung, single hung and slider type windows such that the sash or sashes of such windows may be tilted or pivoted inwardly to permit easy cleaning and removal.

In one typical example of windows of this type, the frame of a double hung window includes a step-down type main frame jamb and the inner sash is approximately one inch wider than the outer sash. The frame and the sash are made of vinyl. This type of design is conducive to using top surface mounted tilt latches that engage the frame on both ends of the horizontal surface of the sash to lock the sash in position and resist undesired rotation or tilting thereof. The latches must be activated to release the sash and permit pivotal movement thereof. The latches are typically spring loaded, thereby requiring the simultaneous activation of both latches, requiring the user to use both hands to open the window. In addition, with this type of window, when a sash is in an open position, only the tilt latch holds the upper portion of the sash in the frame. If the tilt latch becomes stuck in the retracted position, the sash could fall inward unexpectedly, thereby resulting in an inoperable window. Moreover, the unexpected inward tilting of the sash could damage the window or cause injuries to persons inside the structure.

There remains a need for a window having a pivoting sash which can be disengaged from the frame by individually activating the latches, with one hand.

SUMMARY OF THE INVENTION

This invention provides a window having a frame and at least one sash. The frame includes a sash opening therein and at least one sash engaging surface. The sash includes at least one frame engaging surface and is slidably mounted in the sash opening of the frame so that the frame engaging surface at least partially engages the sash engaging surface. At least one sash stop is mounted in the frame and is movable between an extended position and a retracted position. The sash stop is structured to maintain the sash in position in the sash opening when the sash stop is extended. The sash stops include resilient members mounted between the frame and the sash stop for urging the sash stop into the extended position. At least one latch is rotatably mounted. The latch is positioned adjacent to the sash stop and is rotatable between a closed position in which the latch does not engage the sash stop and an open position. In the open position, the latch engages and depresses the sash stop to permit the sash to be moved thereby so that the sash can be at least partially removed from the frame.

In one embodiment, one end of the sash is rotatably mounted to the frame and the other end may be rotated out of the frame when the latch is opened.

The invention also includes a process for making a window. A plurality of frame members are joined to form a window frame having a sash opening and at least one sash engaging surface. A plurality of sash members are joined to form a window sash having at least one frame engaging surface. At least a portion of the sash is translucent or transparent. The sash is slidably mounted in the sash opening of the frame. The sash engaging surface at least partially engages the frame engaging surface. At least one sash stop is mounted in the frame so that the sash stop is movable between an extended position and a depressed position. The sash stop is positioned to maintain the sash in position in the sash opening when the sash stop is in the extended position. Resilient means are provided between the sash stop and frame for urging the sash stop into the extended position. At least one latch is rotatably mounted on the sash and is positioned adjacent to the sash stop. The latch is rotatable between a closed position and an open position. In the closed position, the latch does not engage the sash stop. In the open position, the latch engages and depresses the sash stop whereby the sash may be at least partially removed from the frame.

It will be appreciated that this invention may be used with single hung windows, double hung windows, slider windows and tilt/slider windows.

It is an object of this invention to provide a window and a method of making a window having a sash which is at least partially removable from the frame.

It is another object of this invention to provide a window and a method of a window that includes at least one rotatably mounted latch for releasing the sash from the position within the frame.

It is yet another object of this invention to provide a window and a method of making a window which provides more than one latch, each of which may be individually opened or closed by the user using one hand.

It is yet another object of this invention to provide a window and a method of making a window wherein the sash may be pivoted out of the frame.

It is yet another object of this invention to provide a window and a method of making a window which may be utilized in single hung, double hung, slider or tilt/slider type windows.

It is a further object of this invention to provide a window and a method of making a window which may be used with windows made of virtually any types of materials.

These and other objects of this invention will become apparent from the description of the preferred embodiment on reference to the attached drawings.

DETAILED DESCRIPTION OF THE PREFERRED EMBODIMENT

Figure 1:
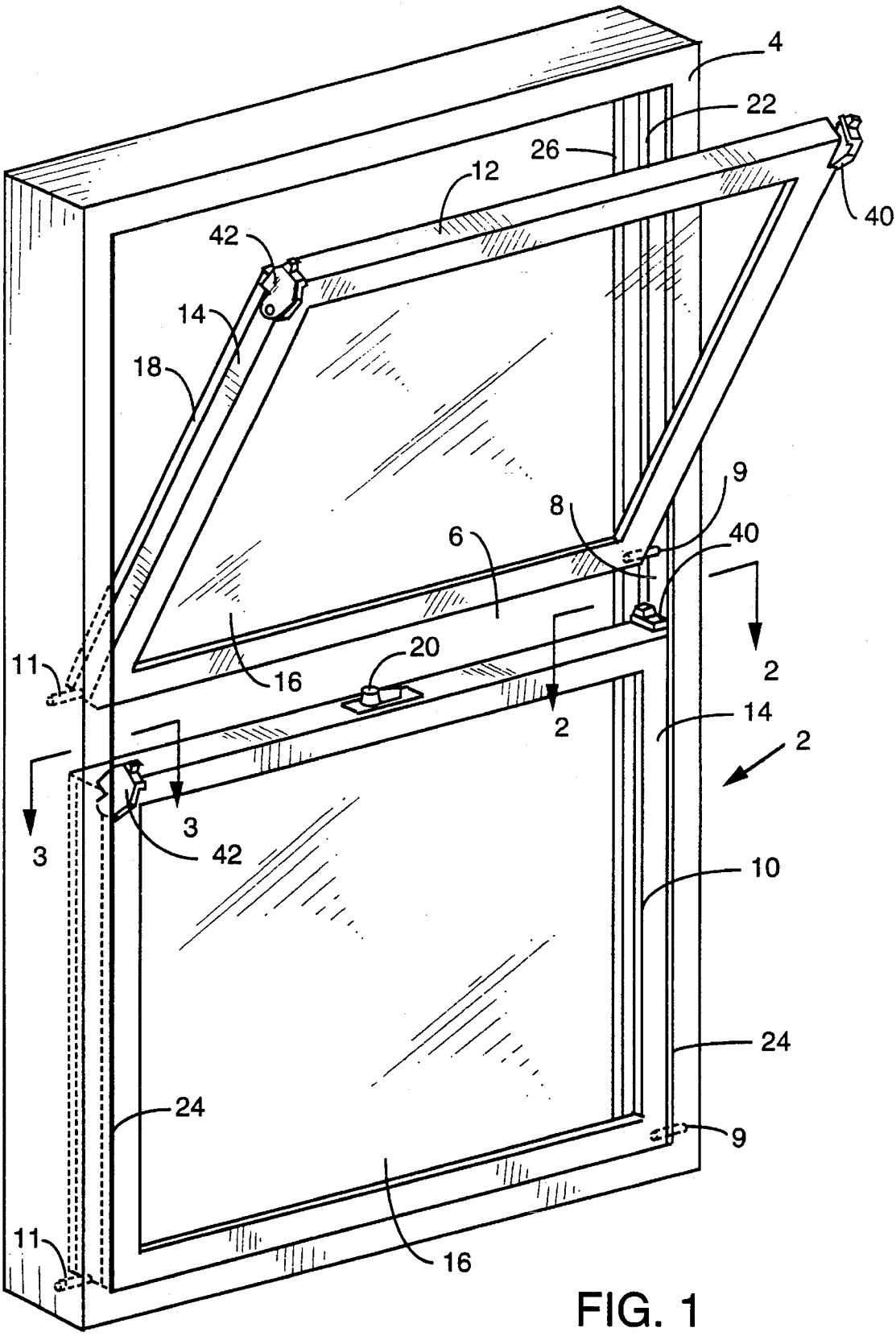
FIG. 1 is a perspective view of a double hung window of this invention.

FIG. 1 shows a perspective view of a double hung window 2 of this invention. Window 2 includes a frame 4 having a sash opening 6 therein. Frame 2 includes a generally inwardly facing sash engaging surface 8 around the perimeter of sash opening 6. In this embodiment, frame 4 is made of a plurality of frame members that have been joined in a manner known to those skilled in the art to form the generally rectangular frame 2. Frame 2 of this type of window is generally higher than it is wide.

Two sashes 10, 12 are slidably mounted for generally vertical movement in sash opening 6 of frame 4. In addition, sashes 10, 12 are rotatably mounted in frame 4 about hinge points 9, 11 at the bottom portions thereof. Hinge points 9, 11 may be conventional hinges or other pivoting devices known to those skilled in the art. Sashes 10, 12 are rotatable about a generally horizontal axis between hinge points 9, 11. Each sash 10, 12 includes a generally rectangular sash frame 14 surrounding pane portion 16 (such as a transparent glass pane or a translucent panel). The sash frames 14 are preferably made by joining a plurality of sash members in a manner known to those skilled in the art. Likewise, pane portion 16 is secured in sash frame 14 in a manner known to those skilled in the art. Each sash includes at least one frame engaging surface 18. Sashes 10, 12 are mounted in sash opening 6 so that sash engaging surface 8 of frame 4 at least partially engages frame engaging surface 18 of sashes 10, 12. Sashes 10, 12 are mounted in offset relationship with respect to one another so that they may be vertically slid to open and close the window 2. A lock 20 may be mounted on the sashes to lock them in the closed position.

The frame members and sash members are preferably made of vinyl and are cladded with wood on the interior (with respect to the structure in which the window is mounted) surfaces thereof. It will be appreciated, however, that the window frame and sash may be made of any suitable material, such as wood, vinyl, aluminum, fiberglass and may be cladded on the interior and exterior surfaces as desired.

Figure 2:
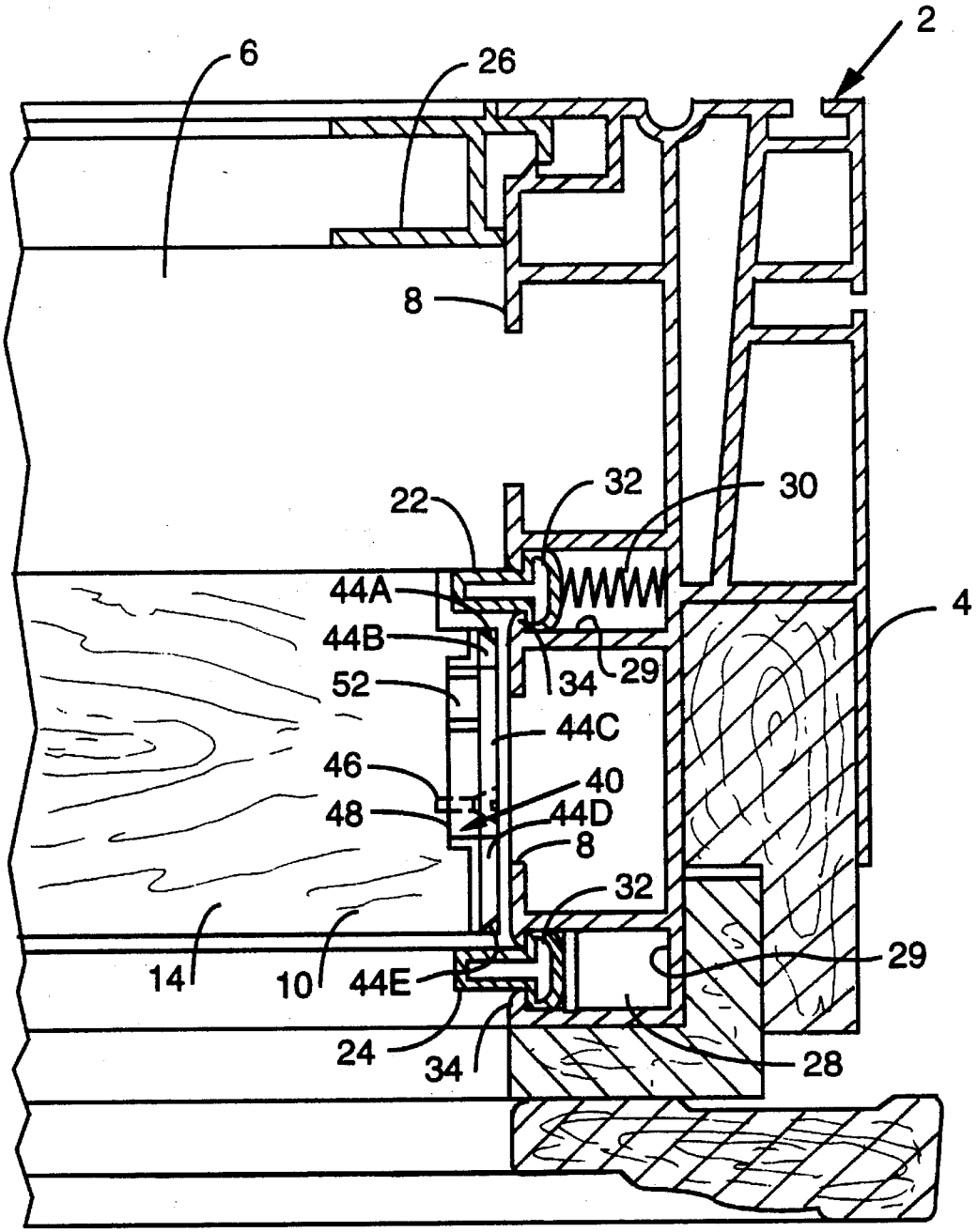
FIG. 2 is a horizontal sectional view of a portion of the window of FIG. 1 taken through line 2—2 of FIG. 1.
Figure 3:
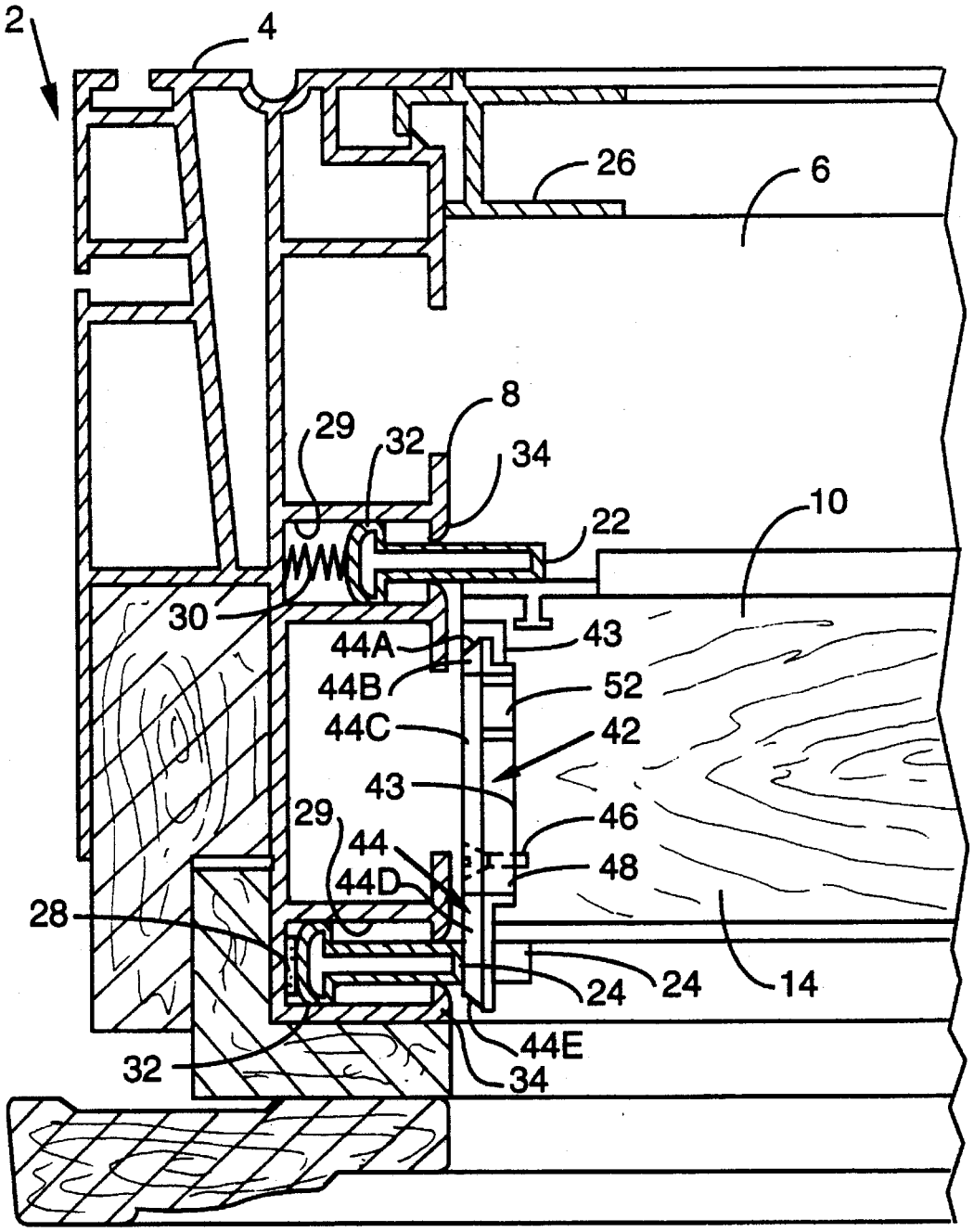
FIG. 3 is a horizontal sectional view of the window of FIG. 1 taken through line 3—3 of FIG. 1.

Referring now to FIGS. 1, 2 and 3, two sash stops 22, 24 are mounted in frame 4 on each of opposite sides of sash opening 6. Sash stops 22, 24 are positioned to engage sash 10. Projection 26 and sash stop 22 are positioned to engage sash 12. Sash stops 22, 24 are movable between an extended position (as best shown in FIG. 2) and a depressed or retracted position (as best shown in FIG. 3) with sash stop 24 . The space between outer sash stop 22 and inner sash stop 24, when the sash stops are extended, defines a track or channel in which inner sash 10 is mounted. The space between outer sash stop 22 and projection 26 on frame 4 defines the track, or channel, in which outer sash 12 is mounted. When sash stops 22, 24 are extended, they maintain sashes 10, 12 in position in frame 4.

Sash stops 22, 24 include resilient means for urging the sash stop into the extended position. The resilient means preferably is a foam pad or strips 28 or a spring 30 mounted between the sash stop 22, 24 and frame 4 in frame channels 29. The resilient means must be compressible to enable the sash stops 22, 24 to be urged into the retracted position. Sash stops 22, 24 are preferably generally "T" shaped in cross section. The enlarged head 32 of the sash stops preferably engage the resilient means and holds the sash stop in place in a reentrant throat 34 formed in frame 4.

Sash stops 22, 24 are preferably made from the same material from which the window frame 4 is made, such as vinyl, but may be made from any suitable materials known to those skilled in art. In a preferred embodiment, sash stops 22, 24 are elongated and generally are coextensive with the vertical sides of sash opening 6 of frame 4. It will be appreciated, however, that the sash stops may be mounted in any desired configuration.

The resilient means are preferably foam strips 28 that are coextensive with the length of sash stops 22, 24. In a preferred embodiment, foam strips 28 are made from polyurethane ether foam with a mylar film attached to the interior face thereof. The mylar film retards mechanical deterioration of the foam and protects it from airborne pollutants, chemicals, window cleaning agents and the like. It will be appreciated, however, that any suitable resilient means may be used.

Referring again to FIG. 1, two latches 40, 42 are mounted on an upper portion of each sash 10, 12 adjacent to sash stops 22, 24. Latches 40, 42 are preferably mounted on opposite sides of the upper portions of the vertical sides of the sash frames 14 of sashes 10, 12.

Figure 4:
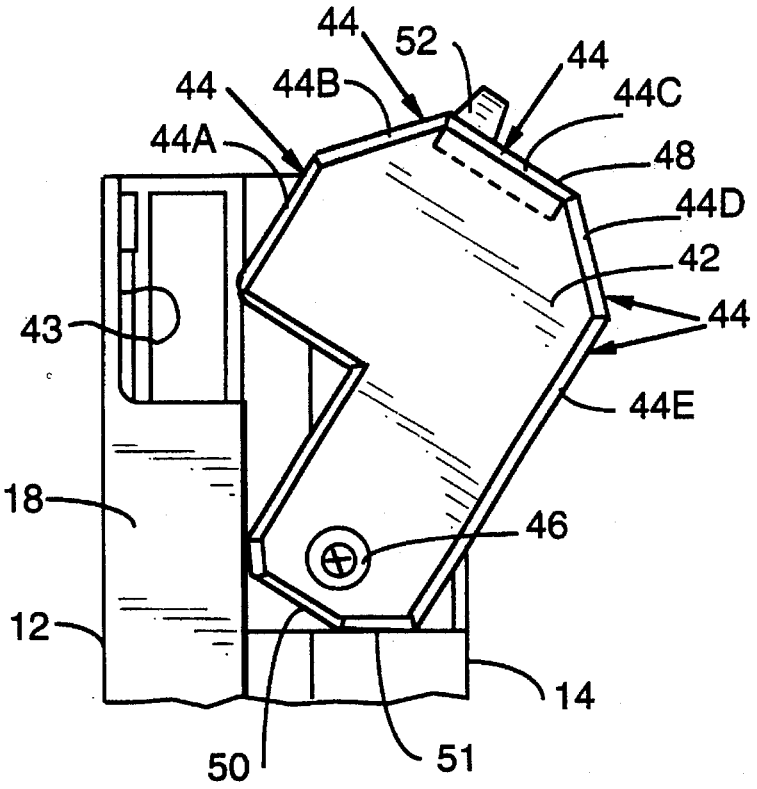
FIG. 4 is a side view of a portion of a sash of the window of FIG. 1 showing the latch in an open position.

Referring now to FIGS. 2–5, latches 40, 42 are individually rotatably between a closed position (FIGS. 2 and 5) and an open position (FIGS. 3 and 4). Latches 40, 42 are preferably mounted in a recessed portion 43 on the sash on which they are made so that the exterior surfaces of latches 40, 42 are generally flush with frame engaging surfaces 18 on such sash. As shown more particularly in FIGS. 2 and 5, in the closed position, latches 40, 42 preferably do not extend beyond the extent of the thickness of sash frames 14 and do not engage sash stops 22, 24. With latches 40, 42 in the closed position, the sashes 10 for example, may be raised and lowered on the track formed between the sash stops 22, 24 to open and close the window. When latch 42 on the inner sash 10 is rotated inwardly to the open position, it engages inner sash stop 24 and forces it into the retracted position, as is more clearly shown in FIG. 3. When both latches 40, 42 on inner sash 10 are in the open position thereby depressing inner sash stops 24, the top end of inner sash 10 may be rotated inwardly about hinge points 9, 11, thereby permitting access to the exterior surface of sash 10 from the interior of the structure. Likewise, when latches 40, 42 of outer sash 12 are rotated into the open position, outer sash stops 22 will be engaged and depressed and outer sash 12 may be rotated about hinge points 9, 11 (see FIG. 1). As outer sash 12 is rotated, latches 40, 42 will engage inner sash stops 24 and force them into the retracted position to permit outer sash 12 to be rotated therepast. The bottom portions of sashes 10, 12 will remain in place in frame 4 when the top portions thereof are rotated inwardly, as discussed hereinbefore. The frame engaging surfaces near the bottom portions of the sashes 12 and 10 will engage sash stops 22 and 24, respectively, to hold them in the depressed, or recessed, position while the sashes are so rotated. Latches 40, 42 are preferably constructed of an ultraviolet resistant, die-east polycarbonate material. It will be appreciated, however, that any suitable material, such as aluminum, steel, nylon or other plastic-like material, may be used. When sashes 10, 12 are rotated back into position in frame 4, latches 40, 42 may be outwardly rotated to the closed position, thereby permitting sash stops 22, 24 to return to the extended positions. Window 2 is then again ready for normal use.

Figure 5:
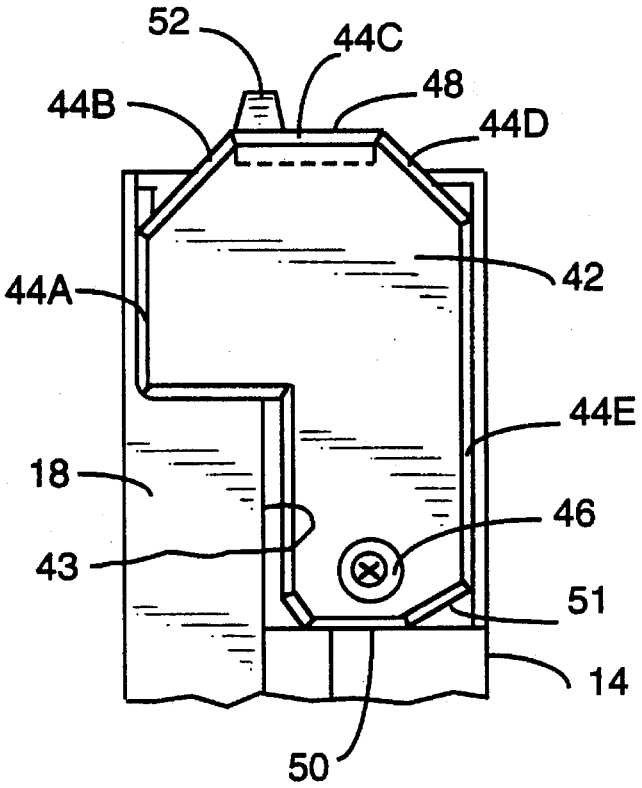
FIG. 5 is a side view of a portion of a sash of the window of FIG. 1 showing a latch in a closed position.

Referring to FIGS. 4 and 5, a preferred embodiment of latch 42 is shown. It will be appreciated that latch 40 is preferably generally the same configuration as latch 42, except it will be a mirror image of latch 42. Latch 42 is generally an inverted "L"-shape. Accordingly, the following description of latch 42 also applies to latch 40. The outer edges of latch 42 are provided with chamfered surfaces 44 44,including labels 44A, 44B, 44C, 44D, 44E for convenience of reference in FIGS. 2–5 to assist in easy engagement and depression of 40 is rotated. The outer edges are preferably chamfered at an angle of about 15 to 45 to eliminate the sharp comers that would be created by the intersection perpendicular surfaces of the latch and to assist in engagement of latch 40 and the sash stops. The comers of the sash stops may also be chamfered to further assist in engagement of the latches and the sash stops. Latch 42 is rotatably mounted to sash 10 using a screw 46 or other suitable fastener. The axis of rotation of latch 42 is eccentric with respect to the general geometric center of latch 40. Preferably, the center of rotation (about screw 46) of latch 42 is about ½ to 3 inches from the upper surface 48 of latch 42. The center of rotation of latch 42 is also preferably about ½ to 2 inches from the sash stop immediately adjacent thereto. In addition, the inner bottom surface 50 of latch 42 may be beveled (51) to engage sash frame 14 to create a stop for inward rotation of latch 42. Latch 42 preferably rotates about 10° to 120° to engage the immediately adjacent sash stop.

Latch 42 may also be provided with a user engagable projection 52 extending from the upper edge 48 thereof. Projection 52 creates a handle that the user may engage to rotate latch 40 as desired. It will be appreciated that each latch 40, 42 may be rotated into the opened or closed position independently of the position of the other latches. The force of the sash stop pushing against the open latch and the friction between the latch and the sash will hold the latch in the open position while the opposite latch is opened, thereby enabling a user may open and close the latches independently of one another.

Figure 6:
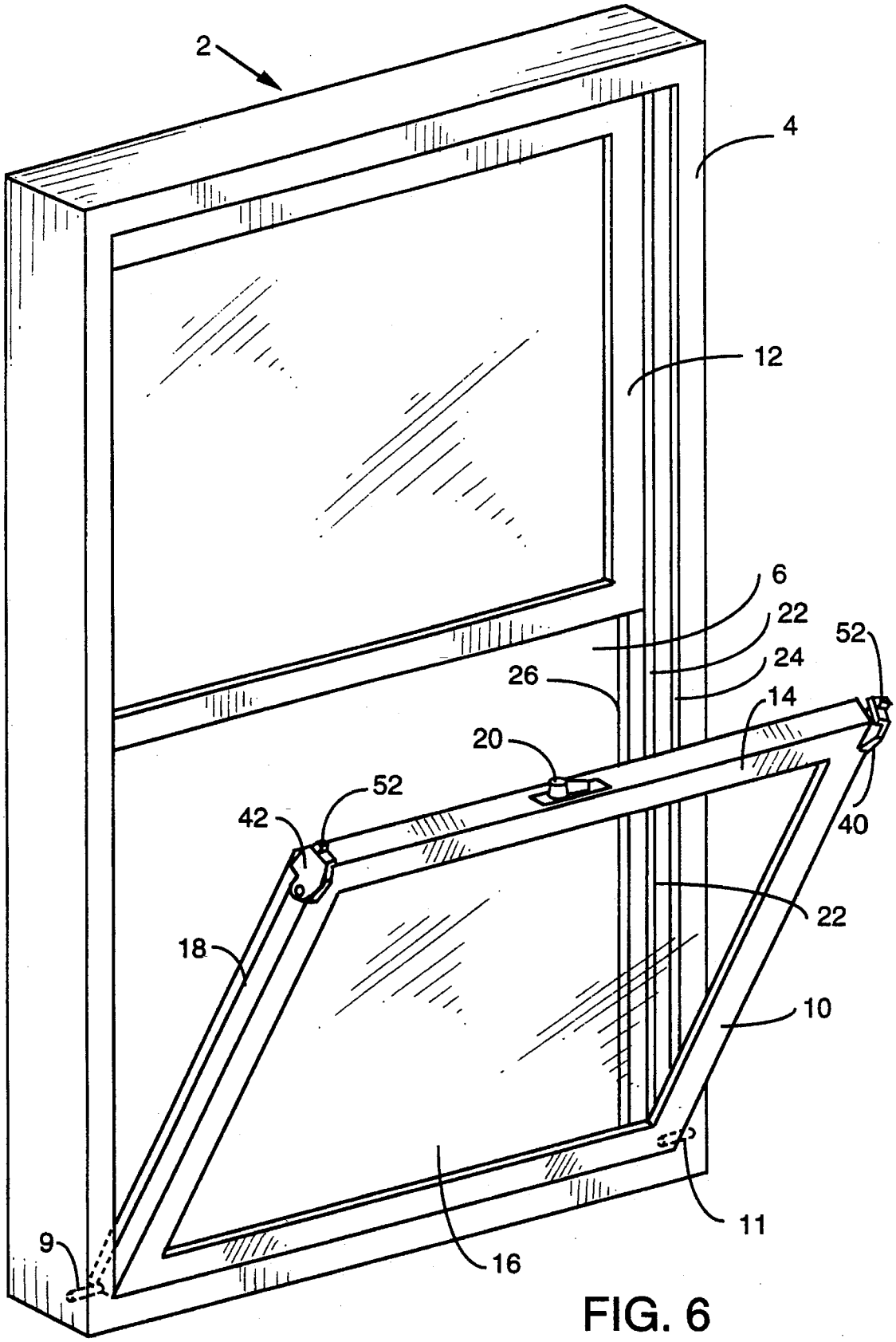
FIG. 6 is a perspective view of single hung window of this invention.

Referring to FIG. 6, there is shown an embodiment of this invention in a single hung window. This window is of generally the same configuration and structure of the window shown in FIGS. 1–5, except that only the inner sash is movable. The upper, or outer, sash is fixed in position. The reference numbers used to describe the embodiment of FIGS. 1–4 are also used to identify like components of the embodiment shown in FIG. 6.

Figure 7:
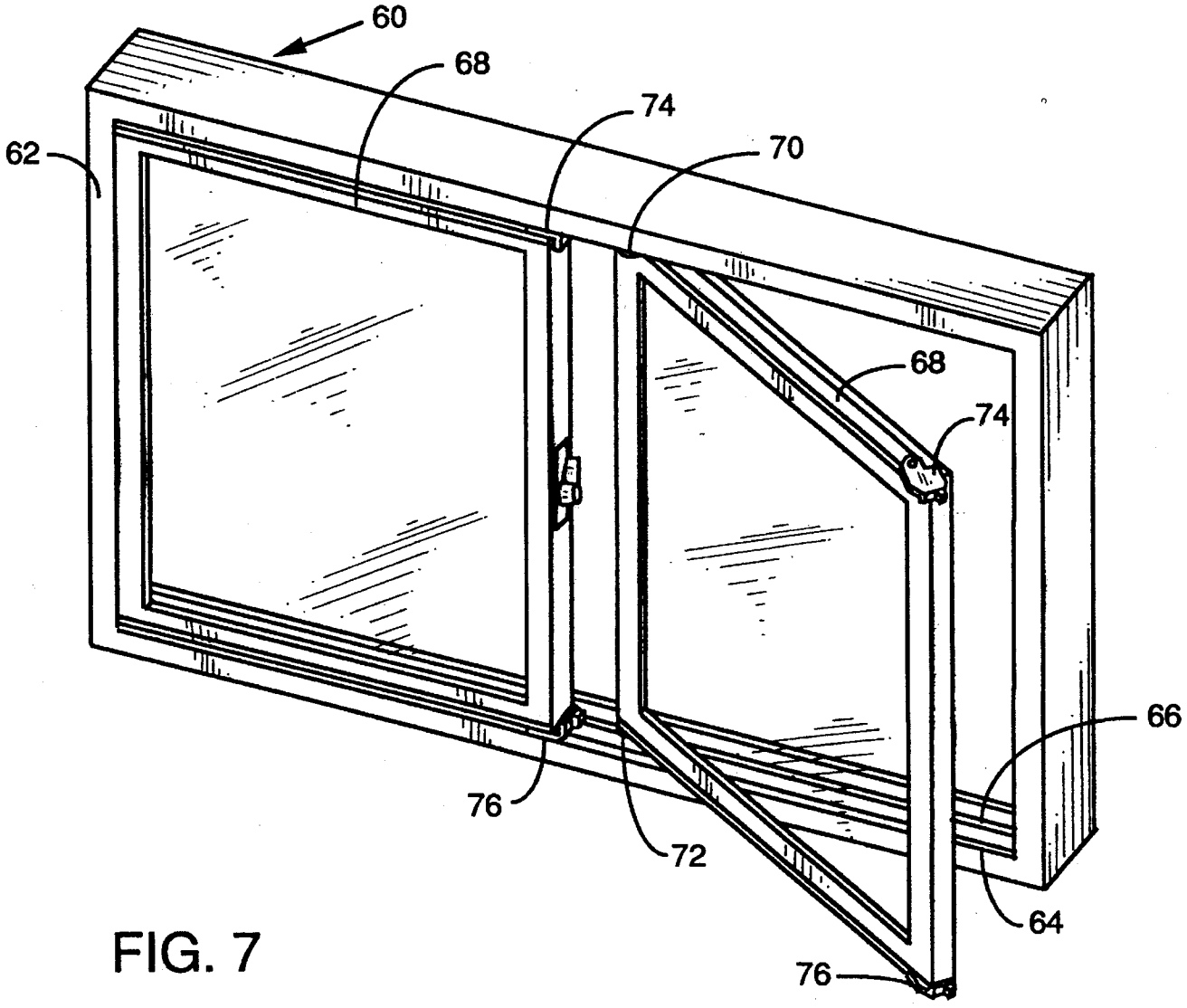
FIG. 7 is a perspective view of a slider window of this invention.

FIG. 7 shows another embodiment of this invention. Window 60 is a tilt/slider type window having at least one horizontally sliding sash. Frame 62 is generally wider than it is high, and otherwise of generally the same configuration and structure as the frame of the window of FIG. 1. Sash stops 64, 66 are mounted on the horizontal portions of frame 62, as discussed hereinbefore with respect to the sash stops of the embodiment of FIG. 1. At least one sash 68 is mounted in frame 62 for generally horizontal sliding movement. In addition, sash 68 is rotatably mounted to frame 62 for rotation about a generally vertically oriented axis of rotation on one end thereof at hinge points 70, 72. Latches 74, 76 are rotatably mounted on the upper and lower portions of sash 68 thereof adjacent to the comers of sash opposite hinge points 70, 72. In operation, window 60 works in substantially the same manner as window 2, described hereinbefore, except that sliding movement of sash 68 is in the horizontal direction rather than vertical and rotation of sash 68 is about a vertical axis rather than a horizontal axis. The configuration of latches 74, 76 is substantially the same that of latches 40, 42 described hereinbefore.

Figure 8:
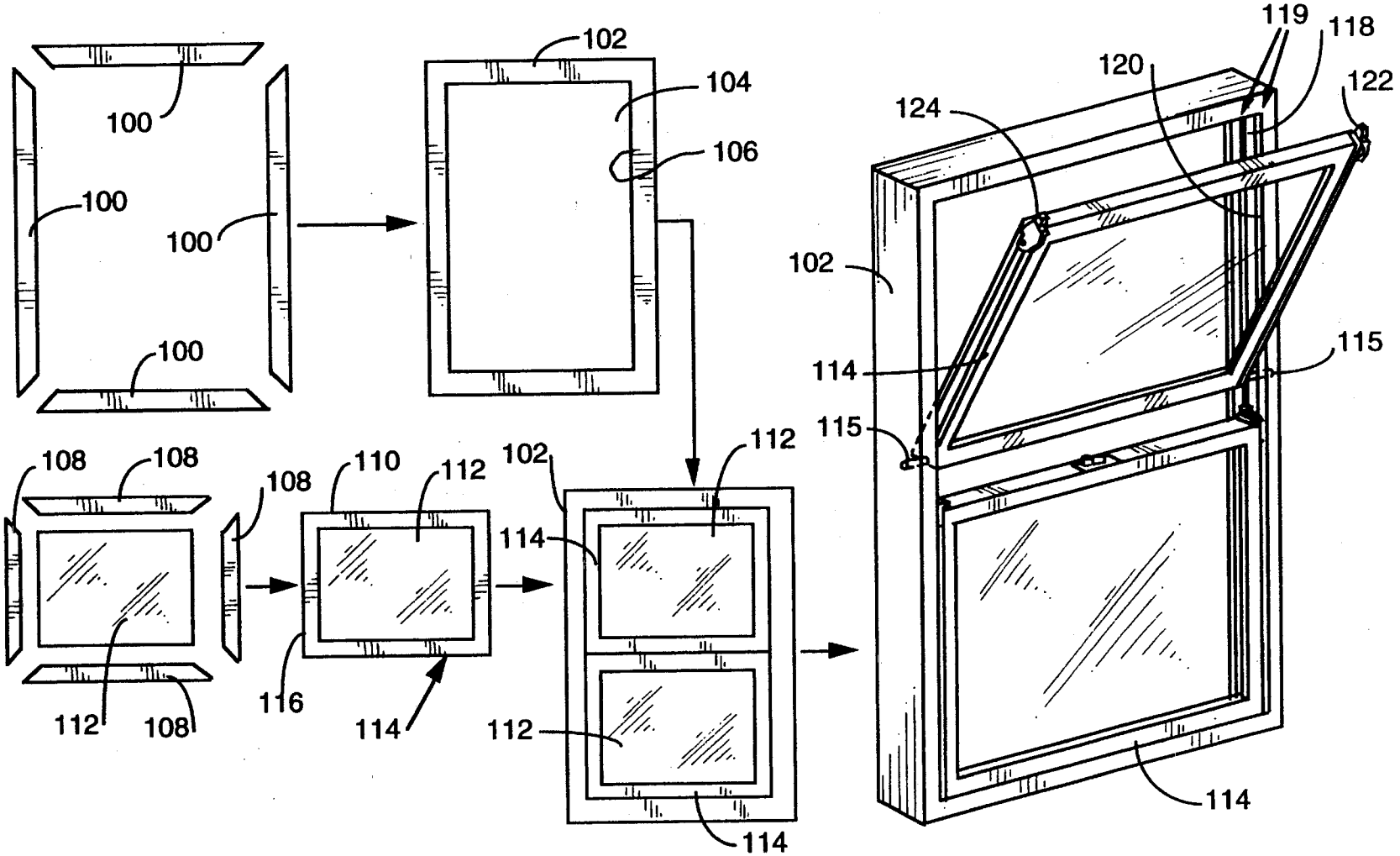
FIG. 8 is a schematic illustration of the method of this invention.

Referring to FIG. 8, there is shown a schematic representation of the method of this invention. A plurality of frame members 100 are joined to form a window frame 102. Frame 102 has a sash opening 104 and at least one sash engaging surface 106. A plurality of sash members 108 are joined to form at least one sash frame 110. A translucent or transparent pane 112 is mounted in sash frame t0 110 to form a window sash 114. Sash 114 includes at least one frame engaging surface 116. Each sash 114 is slidably mounted in frame 102 so that frame engaging surface 116 at least partially engages sash engaging surface 106. Each sash 114 is also rotatably mounted in frame 102 on hinges 115 (or other pivoting device known to those skilled in the art) so as to be rotatable generally inwardly about a horizontal axis through hinges 115. The window thereby formed is shown as a double hung window having two generally vertically movable sashes 114. However, it will be appreciated that this method could also be used to make a single hung window or tilt/slide windows. Sash stops 118, 120 are mounted in the vertical members of frame 102. Sash stops 118, 120 are movable between an extended position and a retracted, or depressed, position. Sash stops 118, 120 are structured and positioned to maintain sashes 114 in position in frame 102 when sash stops 118, 120 are in the extended position. Resilient means 119, such as a foam strip or a spring, are mounted between sash stops 118, 120 and frame 102 for urging sash stops 118, 120 into the extended position.

Latches 122, 124 are rotatably mounted on the vertical members of sash 114 adjacent to the upper ends thereof. Latches 122, 124 are rotatably movable between a closed position and an open position. In the closed position, latches 122, 124 do not engage sash stops 118, 120. In the open position, latches 122, 124 engage and depress sash stops 118, 120 to permit the sash 114 to be rotated generally inwardly about hinge 115 for cleaning and the like. After cleaning, sash 114 may be rotated back into position in frame 102. Latches 122, 124 are independently rotatable.

It will be appreciated that this invention provides a window having at least one inwardly pivoting sash that may be disengaged from the frame by independently operating the locking latches, and a method of making such a window.

Whereas particular embodiments of this invention have been described for purposes of illustration, it will be evident to those skilled in the art that numerous variations in detail may be made without departing from the invention defined in the appended claims.

What is claimed is:

1. A window, comprising:

a frame having a sash opening therein and at least one sash engaging surface;

at least one sash having at least one pane member and at least one frame engaging surface and being slidably mounted in said sash opening of said frame so that said frame engaging surface engages said sash engaging surface;

at least one sash stop mounted in said frame and being movable between an extended position and a retracted position, said sash stop structured to maintain said sash in position in said sash opening of said frame when said sash stop is in the extended position, said sash stop including resilient means between said frame and said sash stop for urging said sash stop into the extended position; and at least one latch rotatably mounted on said sash positioned adjacent to said sash stop and being rotatable between a closed position in which said latch does not engage said sash stop and an open position in which said latch engages and depresses said sash stop, whereby said sash may be at least partially removed from said frame.

2. The window of claim 1, wherein two said sash stops are provided for each sash, said sash stops mounted on opposite sides of said sash opening of said frame; and two said latches are provided on each sash, each said latch being operable independently of the other.

3. The window of claim 2, wherein said sash has a first portion and a second end, said first portion being rotatably mounted on said frame, whereby said second end of said sash may be rotatably moved away from said frame.

4. The window of claim 1, wherein said resilient means include at least one resilient foam strip extending between said sash stop and said frame.

5. The window of claim 1, wherein said resilient means includes at least one spring mounted between said sash stop and said frame.

6. The window of claim 1, wherein said sash includes at least one recessed portion on said frame engaging surface;

said latch has an outer surface; and said latch is mounted in said recessed portion so that said outer surface of said latch is positioned in generally coplanar relationship with said frame engaging surface of said sash.

7. The window of claim 3, wherein said latch is mounted on said second portion of said sash.

8. The window of claim 7, wherein said latch has at least one chamfered surface positioned to engage said sash stop to facilitate depression of said sash stop.

9. The window of claim 8, wherein the window is a double hung window having two generally vertically slidable sashes mounted on offset relationship with respect to one another.

10. The window of claim 8, wherein the window is a slider window having at least one generally horizontally slidable sash.

11. The window of claim 8, wherein the window is a single hung window having one generally vertically slidable sash.

12. The window of claim 1, wherein said latch includes user engagable means projecting therefrom for enabling a user to engage and move said latch.

* * * * *

UNITED STATES PATENT AND TRADEMARK OFFICE

CERTIFICATE OF CORRECTION

PATENT NO. : 5,592,781

DATED : January 14, 1997

INVENTOR(S) : GERALD D. MAURO

It is certified that error appears in the above-identified patent and that said Letters Patent is hereby corrected as shown below:

In column 1, line 12, "modem" should be --modern--.

In column 4, line 29, "made" should be --mounted--.

In column 4, line 58, "die-east" should be --die-cast--.

In column 5, line 6, "44" (first occurrence) should be deleted.

In column 5, line 9, "45" should be --45°--.

In column 5, line 10, "comers" should be --corners--.

In column 5, line 12, "comers" should be --corners--.

In column 5, line 58, "comers" should be --corners--.

In column 6, line 5, "t0" should be deleted.

Signed and Sealed this

Ninth Day of December, 1997

Bruce Lehman

*Attest:*

BRUCE LEHMAN

*Attesting Officer*

*Commissioner of Patents and Trademarks*